US009573381B2

(12) United States Patent
Kanda et al.

(10) Patent No.: US 9,573,381 B2
(45) Date of Patent: Feb. 21, 2017

(54) PRINTING APPARATUS AND BUBBLE EXHAUST METHOD THEREFOR

(71) Applicant: CANON KABUSHIKI KAISHA, Tokyo (JP)

(72) Inventors: Hidehiko Kanda, Yokohama (JP); Monta Matsui, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/531,045

(22) Filed: Nov. 3, 2014

(65) Prior Publication Data

US 2015/0145933 A1 May 28, 2015

(30) Foreign Application Priority Data

Nov. 22, 2013 (JP) ..... 2013-242361

(51) Int. Cl.

| | |
|---|---|
| ***B41J 2/19*** | (2006.01) |
| ***B41J 29/38*** | (2006.01) |
| ***B41J 2/165*** | (2006.01) |
| *B41J 2/175* | (2006.01) |

(52) U.S. Cl.

CPC ..... *B41J 2/19* (2013.01); *B41J 2/16508* (2013.01); *B41J 2/16532* (2013.01); *B41J 29/38* (2013.01); *B41J 2/17596* (2013.01)

(58) Field of Classification Search

None

See application file for complete search history.

(56) References Cited

U.S. PATENT DOCUMENTS

| | | | |
|---|---|---|---|
| 5,949,447 | A | 9/1999 | Arai et al. |
| 5,980,012 | A | 11/1999 | Fujita et al. |
| 6,027,196 | A | 2/2000 | Gotoh et al. |
| 6,113,210 | A | 9/2000 | Gotoh et al. |
| 6,120,129 | A | 9/2000 | Iwasaki et al. |

(Continued)

FOREIGN PATENT DOCUMENTS

| | | | |
|---|---|---|---|
| JP | 06-055742 | A | 3/1994 |
| JP | 10258515 | A * | 9/1998 |

(Continued)

OTHER PUBLICATIONS

Machine Translation of Recovering Device for Ink-Jet Printer (JP 10258515 A), Sep. 29, 1998, Paragraphs 0002, 0029, 0043, and 0053.*

(Continued)

*Primary Examiner* — Lisa M Solomon

(74) *Attorney, Agent, or Firm* — Fitzpatrick, Cella, Harper & Scinto

(57) ABSTRACT

An embodiment of this invention implements both suppression of occurrence of a print failure, and suppression of wasteful ink consumption along with bubble exhaust. Bubble sucking is performed as follows in a printing apparatus including a printhead in which a plurality of orifices are provided for discharging ink, an ink tank for supplying ink to the printhead through an ink channel, and a suction unit configured to suck ink from the orifices. A bubble is injected to the ink channel by using, for example, a pump and hollow needle. After injecting the bubble to the ink channel, the suction unit is operated to suck the injected bubble from the orifices.

9 Claims, 12 Drawing Sheets

(56) References Cited

U.S. PATENT DOCUMENTS

| | | | |
|---|---|---|---|
| 6,142,600 | A | 11/2000 | Takahashi et al. |
| 6,145,950 | A | 11/2000 | Ohtsuka et al. |
| 6,244,681 | B1 | 6/2001 | Yano et al. |
| 6,260,938 | B1 | 7/2001 | Ohtsuka et al. |
| 6,712,443 | B2 | 3/2004 | Kanda et al. |
| 6,820,956 | B2 | 11/2004 | Sakamoto et al. |
| 6,857,718 | B2 | 2/2005 | Moriyama et al. |
| 6,913,337 | B2 | 7/2005 | Kuronuma et al. |
| 6,921,218 | B2 | 7/2005 | Moriyama et al. |
| 6,945,623 | B2 | 9/2005 | Sakamoto et al. |
| 6,957,879 | B2 | 10/2005 | Moriyama et al. |
| 7,080,892 | B2 | 7/2006 | Moriyama et al. |
| 7,185,964 | B2 | 3/2007 | Kanda et al. |
| 7,290,855 | B2 | 11/2007 | Chikuma et al. |
| 7,296,872 | B2 | 11/2007 | Hayashi et al. |
| 7,296,877 | B2 | 11/2007 | Chikuma et al. |
| 7,315,393 | B2 | 1/2008 | Kanda et al. |
| 7,325,900 | B2 | 2/2008 | Hayashi et al. |
| 7,344,219 | B2 | 3/2008 | Sakamoto et al. |
| 7,533,962 | B2 | 5/2009 | Masayama et al. |
| 7,706,023 | B2 | 4/2010 | Kanda et al. |
| 7,758,153 | B2 | 7/2010 | Tanaka et al. |
| 7,762,640 | B2 | 7/2010 | Kanda et al. |
| 7,782,350 | B2 | 8/2010 | Tanaka et al. |
| 7,980,672 | B2 | 7/2011 | Umezawa et al. |
| 8,215,473 | B2 | 7/2012 | Baccini et al. |
| 8,384,944 | B2 | 2/2013 | Kawatoko et al. |
| 8,794,737 | B2 * | 8/2014 | Taira ..... B41J 2/16532 347/23 |
| 8,888,223 | B2 | 11/2014 | Oonuki et al. |
| 2006/0279604 | A1 * | 12/2006 | Ueda ..... B41J 2/19 347/36 |

FOREIGN PATENT DOCUMENTS

| | | | |
|---|---|---|---|
| JP | 2004-058398 | A | 2/2004 |
| JP | 2007-098959 | A | 4/2007 |
| JP | 2009-090617 | A | 4/2009 |
| JP | 2011183762 | A * | 9/2011 |
| JP | 2012-024934 | A | 2/2012 |

OTHER PUBLICATIONS

Hizawa, S (JP 2011-183762 A—Machine Translation), "Liquid Jet Apparatus", Sep. 22, 2011, Paragraphs 0022-0038 and Figs. 5(a)-5(b).*

* cited by examiner

| | | BUBBLE SIZE (DIAMETER) [mm] | | | | |
|---|---|---|---|---|---|---|
| | | 0.5 | 1.0 | 1.5 | 2.0 | 2.5 |
| AVERAGE FLUID VELOCITY IN HORIZONTAL CHANNEL [cm/sec] | 0.8 | ○ | ○ | ○ | ○ | ○ |
| | 3.0 | ○ | ○ | ○ | ○ | × |
| | 6.0 | ○ | ○ | ○ | × | × |
| | 11.0 | ○ | ○ | × | × | × |
| | 14.0 | ○ | × | × | × | × |
| | 23.0 | × | × | × | × | × |

○ : BUBBLE DOES NOT MOVE
× : BUBBLE MOVES

FIG. 11

| | AMOUNT OF INK CONSUMED BY SUCTION (WITH RESPECT TO INTERNAL VOLUME OF INK CHANNEL) |
|---|---|
| 0.8 | ABOUT 1.5 TIMES |
| 3.0 | ABOUT 2.0 TIMES |
| 6.0 | ABOUT 4.0 TIMES |
| 11.0 | ABOUT 6.0 TIMES |
| 14.0 | ABOUT 9.0 TIMES |
| 23.0 | ABOUT 12.0 TIMES |

AVERAGE FLUID VELOCITY IN HORIZONTAL CHANNEL [cm/sec]

PRINTING APPARATUS AND BUBBLE EXHAUST METHOD THEREFOR

BACKGROUND OF THE INVENTION

Field of the Invention

The present invention relates to a printing apparatus which prints an image on a printing medium by discharging an ink droplet from each ink orifice arranged in a printhead, and a method for exhausting bubbles from the ink channel of the printing apparatus.

Description of the Related Art

A printing apparatus which prints by discharging ink from the orifices of a printhead to a printing medium includes an ink channel for supplying ink to ink droplet orifices from an ink tank storing the ink. If a bubble which moves by the flow of ink at the time of printing exists in the ink channel, the bubble reaches the orifice, hinders discharge of ink, and causes a print failure. To prevent such a print failure, various techniques have been proposed.

For example, Japanese Patent Laid-Open No. 2007-98959 has disclosed an arrangement in which a valve is arranged in an ink channel between an ink tank and an orifice, and opening/closing of the valve is controlled to increase a suction negative pressure and increase the fluid velocity in the ink channel, thereby improving the bubble exhaust performance from the ink channel. Japanese Patent Laid-Open No. 2004-58398 has disclosed an arrangement in which the bubble exhaust performance from the ink channel is improved by alternately repeating opening/closing of a valve.

Further, Japanese Patent Laid-Open No. 6-55742 has disclosed the following arrangement in order to efficiently exhaust a bubble mixed in an ink orifice and ink chamber. More specifically, an ink supply port, bubble supply port, and bubble suction port are arranged in the ink chamber. A bubble is supplied from the bubble suction port into the ink chamber, and a bubble coalescent with tiny bubbles generated in the ink orifice and ink chamber is exhausted from the bubble suction port.

However, if the suction negative pressure is increased to increase the fluid velocity in the ink channel by using the bubble exhaust arrangements disclosed in Japanese Patent Laid-Open Nos. 2007-98959 and 2004-58398, even the ink fluid flow is also increased. As a result, a large amount of ink is wastefully consumed owing to the high fluid flow. Japanese Patent Laid-Open No. 6-55742 does not describe handling of a bubble generated in the ink channel for supplying ink to the printhead from the ink tank storing the ink.

SUMMARY OF THE INVENTION

Accordingly, the present invention is conceived as a response to the above-described disadvantages of the conventional art.

For example, a printing apparatus and bubble exhaust method according to this invention are capable of implementing both prevention of occurrence of a print failure, and suppression of wasteful ink consumption along with bubble exhaust.

According to one aspect of the present invention, there is provided a printing apparatus comprising: a printhead in which a plurality of orifices are provided for discharging ink; an ink tank for storing ink to be supplied to the printhead; an ink channel for supplying ink from the ink tank to the printhead; a bubble injection unit configured to perform a bubble injection operation to inject a bubble to the ink channel; a suction unit configured to perform a first suction operation and a second suction operation that is stronger than the first suction operation, to suck ink from the printhead; and a control unit configured to control the bubble injection unit and the suction unit, and cause the suction unit to perform the first suction operation for a predetermined time after causing the bubble injection unit to perform the bubble injection operation, and then to cause the suction unit to perform the second suction operation.

According to another aspect of the present invention, there is provided a printing apparatus comprising: a printhead in which a plurality of orifices are provided for discharging ink; an ink tank for storing ink to be supplied to the printhead; an ink channel for supplying ink from the ink tank to the printhead; a bubble injection unit configured to perform a bubble injection operation to inject a bubble to the ink channel; a suction unit configured to perform a suction operation to suck ink from the printhead; a first control unit configured to cause the suction unit to perform the suction operation after causing the bubble injection unit to perform the bubble injection; and a second control unit configured to cause the suction unit to perform the suction operation without causing the bubble injection unit to perform the bubble injection operation.

According to still another aspect of the present invention, there is provided a method for exhausting a bubble in a printing apparatus including: a printhead in which a plurality of orifices are provided for discharging ink; an ink tank for storing ink to be supplied to the printhead; an ink channel for supplying ink from the ink tank to the printhead; a bubble injection unit configured to perform a bubble injection operation to inject a bubble to the ink channel; and a suction unit configured to perform a first suction operation and a second suction operation that is stronger than the first suction operation to suck ink from the printhead, comprising: performing the bubble injection operation by the bubble injection unit; performing the first suction operation for a predetermined time by the suction unit; and performing the second suction operation by the suction unit.

According to still another aspect of the present invention, there is provided a method for exhausting a bubble in a printing apparatus including: a printhead in which a plurality of orifices are provided for discharging ink; an ink tank for storing ink to be supplied to the printhead; an ink channel for supplying ink from the ink tank to the printhead; a bubble injection unit configured to perform a bubble injection operation to inject a bubble to the ink channel; and a suction unit configured to perform a suction operation to suck ink from the printhead, comprising: acquiring an elapsed time since a previous suction operation is performed by the suction unit; and determining whether or not to execute the bubble injection operation by the bubble injection unit before a next suction operation, based on the acquired elapsed time.

The invention is particularly advantageous since both suppression of occurrence of a print failure, and suppression of wasteful ink consumption along with bubble exhaust can be implemented.

Further features of the present invention will become apparent from the following description of exemplary embodiments (with reference to the attached drawings).

BRIEF DESCRIPTION OF THE DRAWINGS

FIG. 11 is a table showing the average fluid velocity in the horizontal channel of the ink channel, and the ratio, to the internal volume of the ink channel, of the amount of ink consumed by suction until a bubble of a size movable at the average fluid velocity is exhausted from an orifice.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

[Arrangement of Printing Apparatus]

Figure 1:
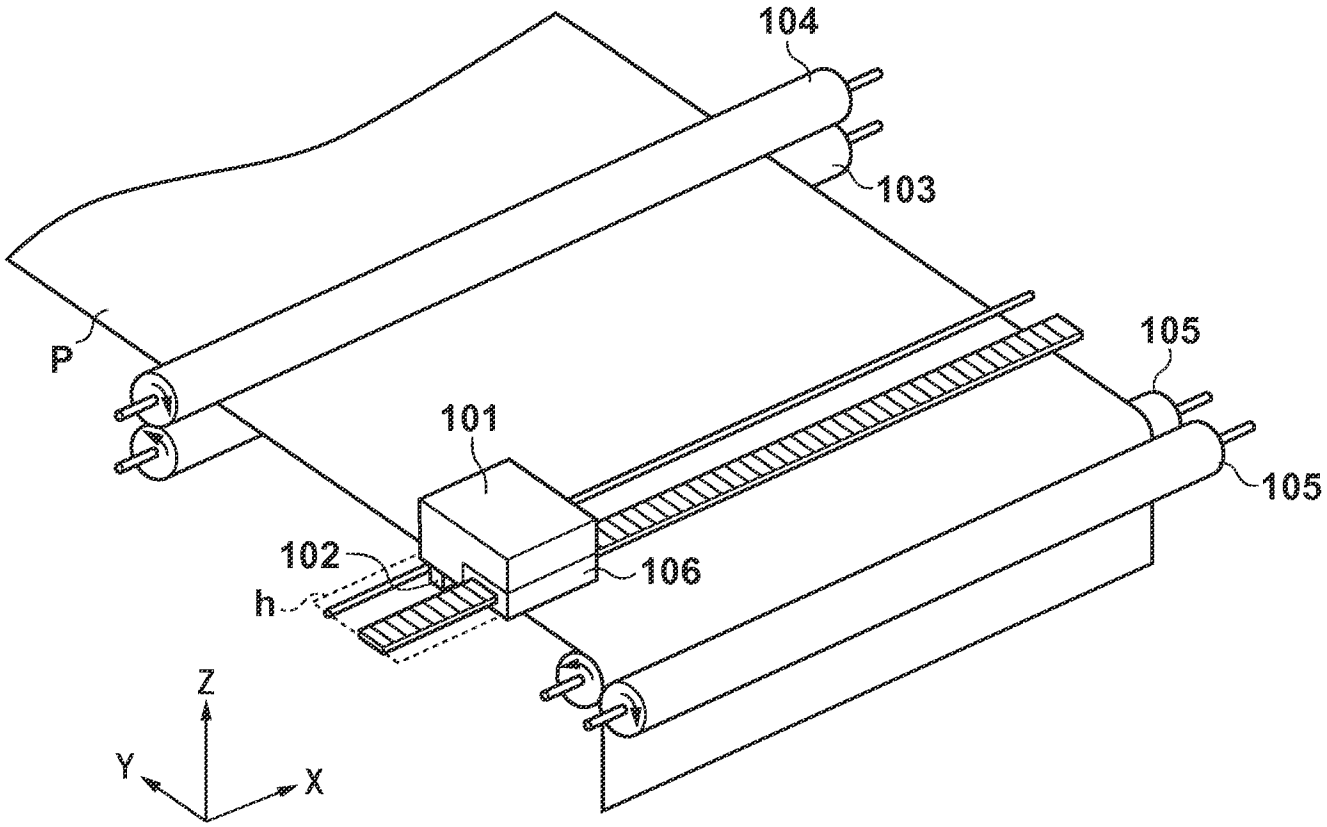
FIG. 1 is a perspective view showing the schematic outer arrangement of an inkjet printing apparatus as an exemplary embodiment of the present invention.

FIG. 1 is a perspective view showing the main part of an inkjet printing apparatus (to be referred to as a printing apparatus hereinafter) as an exemplary embodiment of the present invention.

In FIG. 1, an ink cartridge 101 is constituted by an ink tank storing ink, and a printhead 102 in which a plurality of print elements are integrated and arrayed. The printhead 102 may be constituted separately from the ink tank. The print element of the printhead 102 includes an ink orifice, and a corresponding discharge energy generation element. As the discharge energy generation element, a heater (heat generation element), piezoelectric element, or the like is used. In the following description, a portion including the ink orifice and discharge energy generation element will also be called a "nozzle".

A conveyance roller 103 rotates together with an auxiliary roller 104 in a direction indicated by an arrow while pressing printing paper (printing medium) P, thereby intermittently conveying the printing medium P in a direction indicated by an arrow Y (sub-scanning direction). Feed rollers 105 feed the printing medium P, and also press the printing medium P similarly to the conveyance roller 103 and auxiliary roller 104. The ink cartridge 101 is mounted on a carriage 106, and reciprocates in directions (main scanning directions) indicated by an arrow X. The main scanning direction and sub-scanning direction cross each other, and in the embodiment, are perpendicular to each other. When printing is not performed, or when performing recovery processing of the printhead 102 or the like, the carriage 106 moves to a home position h indicated by a dotted line in FIG. 1, and stands by.

When the carriage 106 at the position (home position) in FIG. 1 receives a printing start instruction before the start of printing, it prints by discharging ink from a plurality of orifices in the printhead 102 while moving in the main scanning direction (X direction). After the end of printing for forming an image up to a printing medium end positioned on a side opposite to the home position, the carriage returns to the original home position, and repeats again printing in the X direction.

Figure 2:
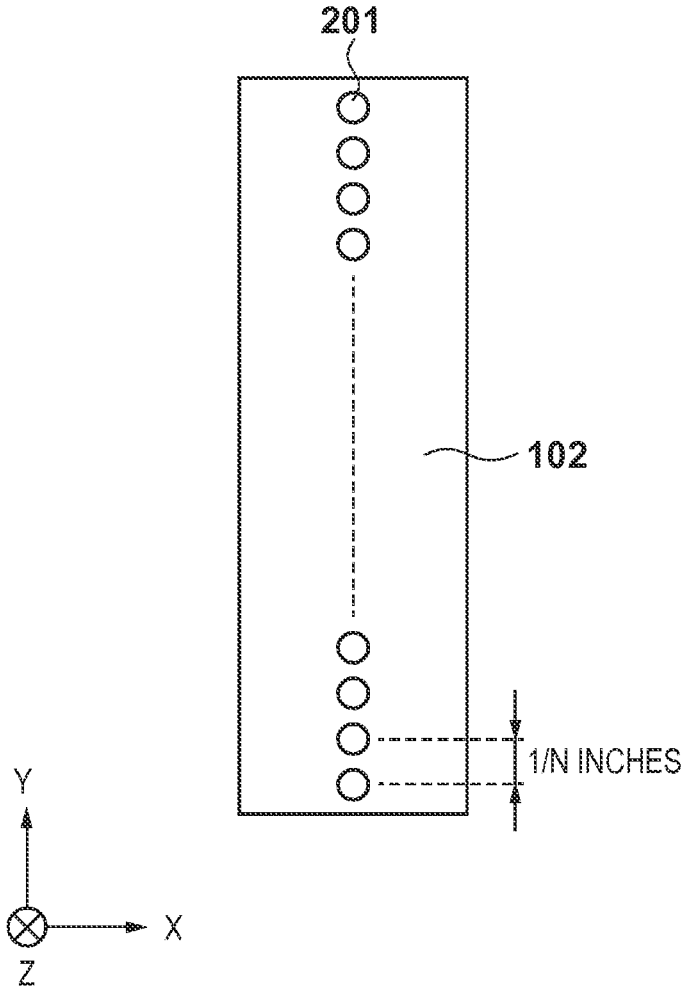
FIG. 2 is a view for explaining the array of ink discharge nozzles in a printhead.

FIG. 2 is a view showing the printhead 102 when viewed from the Z direction in order to explain the array of ink discharge nozzles in the printhead 102. In the printhead 102, orifices 201 are formed as ink orifices. To cope with a print pixel density of N dots per inch, n orifices 201 are arrayed.

Figure 3:
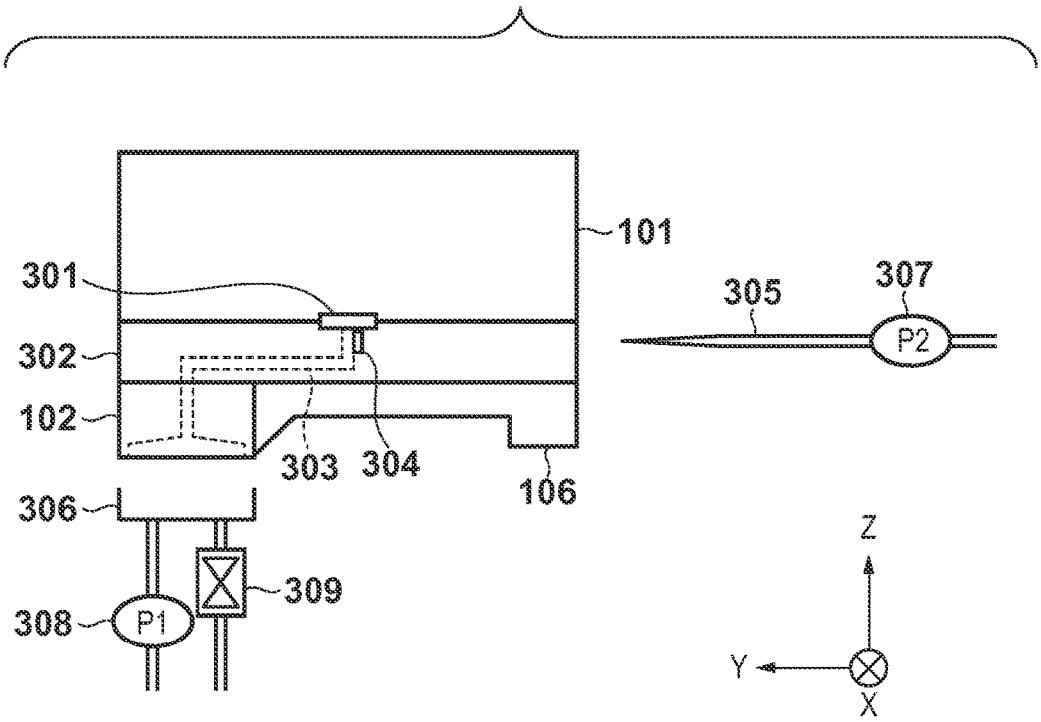
FIG. 3 is a view showing the arrangement of the printing apparatus shown in FIG. 1 at a home position.

FIG. 3 is a view showing the arrangement of the carriage at the home position in the printing apparatus shown in FIG. 1 when viewed from the X direction.

As shown in FIG. 3, an ink channel portion 302 is formed between the ink tank and printhead 102 which constitute the ink cartridge 101. Inside the ink channel portion 302, an ink channel 303 indicated by a broken line is formed. Further, a filter 301 is arranged at a coupling portion with the ink tank to prevent entrance of dust or the like. The ink channel 303 indicated by the broken line is also formed up to the orifice portion for discharging an ink droplet inside the printhead 102.

As for the Z direction, a hollow needle 305 is arranged at the position of the ink channel portion 302 to inject a bubble into the ink channel. The distal end of the hollow needle 305 is sharpened and holed. In correspondence with this, a rubber sealing portion 304 is arranged at a position near the filter 301 in the ink channel 303 formed in the ink channel portion 302. The hollow needle 305 is movable in the Y-axis direction. The ink channel portion 302 present on a path on which the hollow needle 305 moves up to the rubber sealing portion 304 is hollow so that the hollow needle 305 can pass through the ink channel portion 302. Further, a pump (second pump: P2) 307 is provided for the hollow needle 305. After the distal end of the hollow needle 305 reaches the rubber sealing portion 304, the pump 307 is driven to introduce air through the hollow needle 305 and as a result, inject a bubble to the ink channel 303. In terms of an ink flow from the ink tank to the printhead, the rubber sealing portion 304 is arranged immediately below the filter 301 on the upstream side from a portion at which the ink channel becomes horizontal.

Ink is sucked from the orifice of the printhead 102 as follows.

At the time of ink suction, a suction cap 306 facing the orifice formation surface of the printhead 102 is moved in the +Z direction to seal the orifice formation surface of the printhead 102. In a state in which an air communication valve 309 is closed, a pump (first pump: P1) 308 is driven. In response to this, a negative pressure is generated in the suction cap 306 to suck ink from the orifice through the suction cap 306.

After the end of ink suction, the air communication valve 309 is opened to release the pressure in the suction cap 306. The suction cap 306 is moved in the −Z direction, separated from the orifice formation surface, and then stands by.

An operation of injecting a bubble into the ink channel will be explained.

Figure 4:
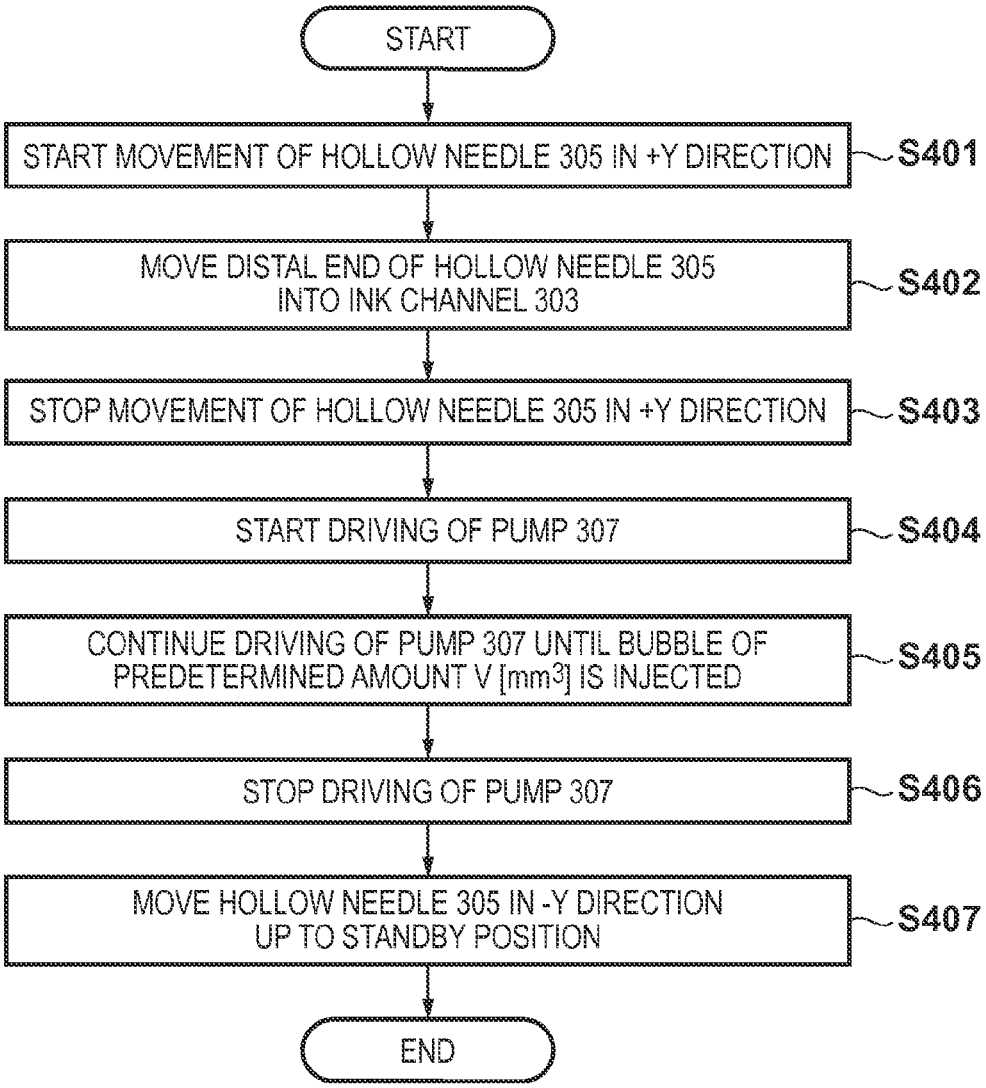
FIG. 4 is a flowchart showing a bubble injection operation to an ink channel.

FIG. 4 is a flowchart showing the operation of a bubble injection process.

First, in step S401, the hollow needle 305 starts moving in the +Y direction. In step S402, the distal end of the hollow needle 305 passes through the rubber sealing portion 304, and the hollow needle 305 moves until it is tightly joined to the ink channel 303 and inserted into the ink channel 303. In step S403, the movement of the hollow needle 305 in the +Y direction is stopped.

Then, in step S404, driving of the pump 307 starts. In step S405, the driving of the pump 307 is continued until a bubble of a predetermined amount V [$mm^3$] is injected to the ink channel through the hole at the distal end of the hollow needle 305.

In step S406, the driving of the pump 307 is stopped, ending the bubble injection. In step S407, the hollow needle 305 is moved in the −Y direction up to the standby position.

Figure 5:
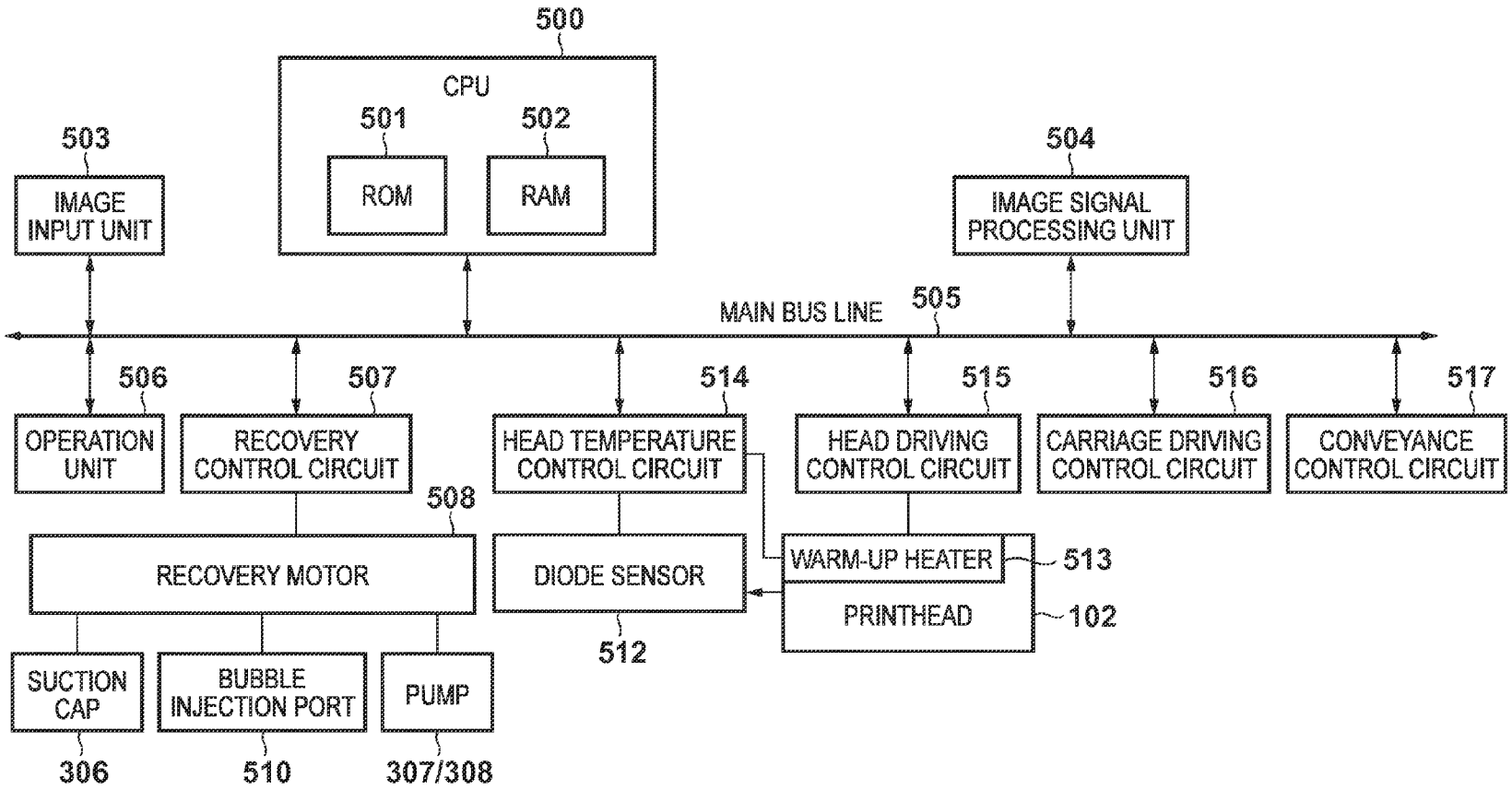
FIG. 5 is a block diagram showing the control arrangement of the printing apparatus shown in FIG. 1.

FIG. 5 is a block diagram showing the control arrangement of the printing apparatus shown in FIG. 1.

As shown in FIG. 5, main building components are connected to a main bus line 505, and can access each other via the main bus line 505. These main building components include an image input unit 503, image signal processing unit 504, CPU 500, operation unit 506, recovery control circuit 507, head temperature control circuit 514, head driving control circuit 515, carriage driving control circuit 516, and conveyance control circuit 517.

The CPU 500 generally includes a ROM 501 and RAM 502, and gives appropriate printing conditions with respect to input information to drive the printhead 102 and print. The ROM 501 stores in advance a program for executing printhead recovery processing. The CPU 500 loads this program into the RAM 502, and executes it. If necessary, the CPU 500 gives recovery conditions such as a preliminary discharge condition to the recovery control circuit 507, the printhead 102, a warm-up heater 513, and the like. A recovery motor 508 drives the above-described printhead 102, the suction cap 306 which faces the printhead 102 at a distance, the hollow needle 305 serving as a bubble injection port 510 which faces the ink channel portion 302 at a distance, and the pumps 307 and 308 which perform suction and bubble injection. The head driving control circuit 515 executes the driving conditions of an electrothermal transducer for ink discharge from the printhead 102, and controls the printhead 102 to perform normal preliminary discharge and printing ink discharge.

On a substrate on which the electrothermal transducer for ink discharge from the printhead 102 is arranged, the warm-up heater 513 is sometimes arranged. The warm-up heater 513 can adjust the ink temperature in the printhead to a desired set temperature by heating. A diode sensor 512 is similarly arranged on the substrate, and measures a substantial ink temperature in the printhead. The diode sensor 512 may be arranged not on the substrate but outside, or may exist near the printhead.

Several embodiments of bubble exhaust control from the ink channel of the printing apparatus having the above-described arrangement will be explained below.

First Embodiment

The first embodiment will be described on the premise of the following conditions.

More specifically, one printhead having the arrangement shown in FIG. 2 discharges black ink having a surface tension γ of about 35 [mN/m]. The printhead has the number L of orifices (L=512), and is constituted to implement a print pixel density of 600 dpi at an orifice interval of 1/600 inches. The printhead is also constituted so that each orifice of the printhead can discharge an ink droplet of about 30 pl. The discharge frequency for stably discharging this ink droplet is 15 kHz. The speed of a carriage 106 supporting a printhead 102 in the main scanning direction is about 25 inches/sec at a printing resolution of 600 dpi in the main scanning direction. A maximum fluid flow at the time of printing by ink droplets from all orifices at a resolution of 600 dpi is 30 pl×512×15000=about 0.23 [ml/sec].

In the embodiment, the inner diameter of a horizontal channel in which the top surface of an ink channel 303 shown in FIG. 3 exists is 3.0 [mm]. The average fluid velocity in the tube at the maximum fluid flow becomes about 3.4 [cm/sec].

Figures 6, 7:
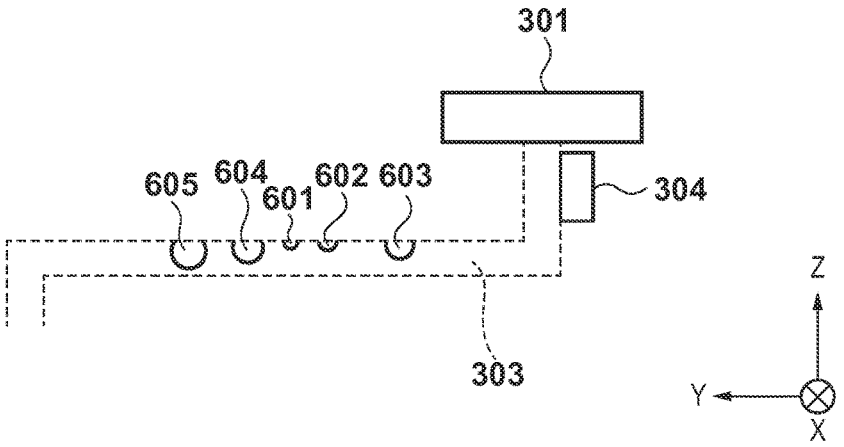
FIG. 6 is a view showing a state in which bubbles are attached in the horizontal channel of the ink channel shown in FIG. 3.
FIG. 7 is a table showing the relationship between an average fluid velocity in the horizontal channel of the ink channel, and the state of movement, in the +Y direction, of a bubble of each size attached in the horizontal channel, as shown in FIG. 6.

FIG. 6 is a view showing a state in which bubbles are attached in the horizontal channel of the ink channel 303 shown in FIG. 3.

In FIG. 6, the sizes (diameters) of bubbles 601, 602, 603, 604, and 605 are about 0.5 [mm], about 1.0 [mm], about 1.5 [mm], about 2.0 [mm], and about 2.5 [mm], respectively. The static contact angle of the channel member with respect to black ink having the surface tension γ of about 35 [mN/m] is about 60°, and the static contact angle of a bubble upon air-liquid inversion is about 130°.

FIG. 7 is a table showing the relationship between an average fluid velocity in the horizontal channel of the ink channel 303, and the state of movement, in the +Y direction, of a bubble of each size attached in the horizontal channel, as shown in FIG. 6. In FIG. 7, "X" represents that a bubble moves, and "○" represents that a bubble does not move and is attached in the channel.

As described above, the average fluid velocity in the horizontal channel when printing an image at a printing duty of 100% using all orifices is about 3.4 [cm/sec]. In this case, FIG. 7 shows that a bubble of about 2.5 [mm] in size (diameter) attached in the horizontal channel moves. The movement of a bubble causes a print failure. It is apparent that a bubble does not move unless the average fluid velocity in the horizontal channel is increased as the bubble size decreases. For example, to exhaust bubbles up to a bubble of 0.5 [mm], the average fluid velocity in the horizontal channel needs to be increased to about 23.0 [cm/sec].

Figure 8:
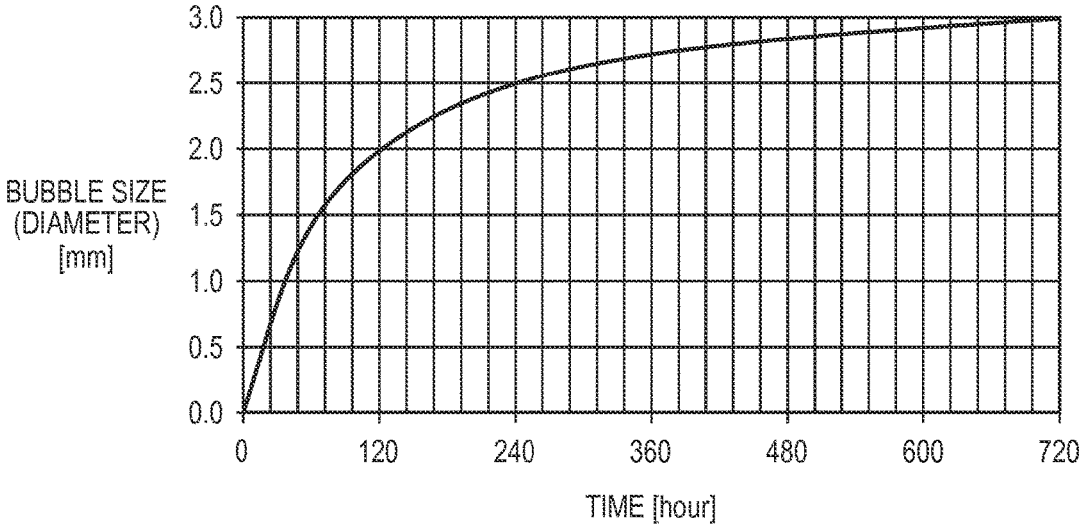
FIG. 8 is a graph showing the growth of a bubble generated in the inner diameter of the horizontal channel of the ink channel.

FIG. 8 is a graph showing, by the bubble size with respect to the elapsed time, bubble growth generated in the 3.0-mm inner diameter of the horizontal channel of the ink channel 303 at a relatively high ambient temperature of about 30° C.

In FIG. 8, the time taken for a bubble to grow from a no-bubble state up to a size of about 2.5 [mm] at which the bubble moves when printing an image at a printing duty of 100% using all orifices is about 240 hours. Thus, a bubble in the horizontal channel needs to be exhausted when printing starts about 240 hours or more after the inside of the ink channel becomes free from a bubble by previous bubble exhaust. To keep long the time till next bubble exhaust, it is desirable to exhaust bubbles as small as possible. For this purpose, in a case where a conventional arrangement is used, the average fluid velocity in the horizontal channel needs to be increased to about 23.0 [cm/sec] based on the relationship shown in FIG. 7.

Since the size of a bubble which moves when printing an image at a printing duty of 100% is about 2.5 [mm], bubbles of a size equal to or smaller than about 2.0 [mm] cannot be exhausted in the conventional arrangement owing to the relationship shown in FIG. 7. If only bubbles of a size equal to or larger than about 2.0 [mm] are exhausted, it suffices to decrease the fluid velocity to an average fluid velocity of about 6.0 [cm/sec] in the horizontal channel. In this case, however, the time interval till next bubble exhaust becomes short. Referring to FIG. 8, bubble exhaust needs to be performed at the start of printing upon the lapse of about 120 hours or more which is about double the above-mentioned frequency.

In this manner, when the average fluid velocity in the horizontal channel is decreased, the time interval till next bubble exhaust is shortened in the conventional arrangement, and bubble exhaust needs to be performed frequently.

Figure 9:
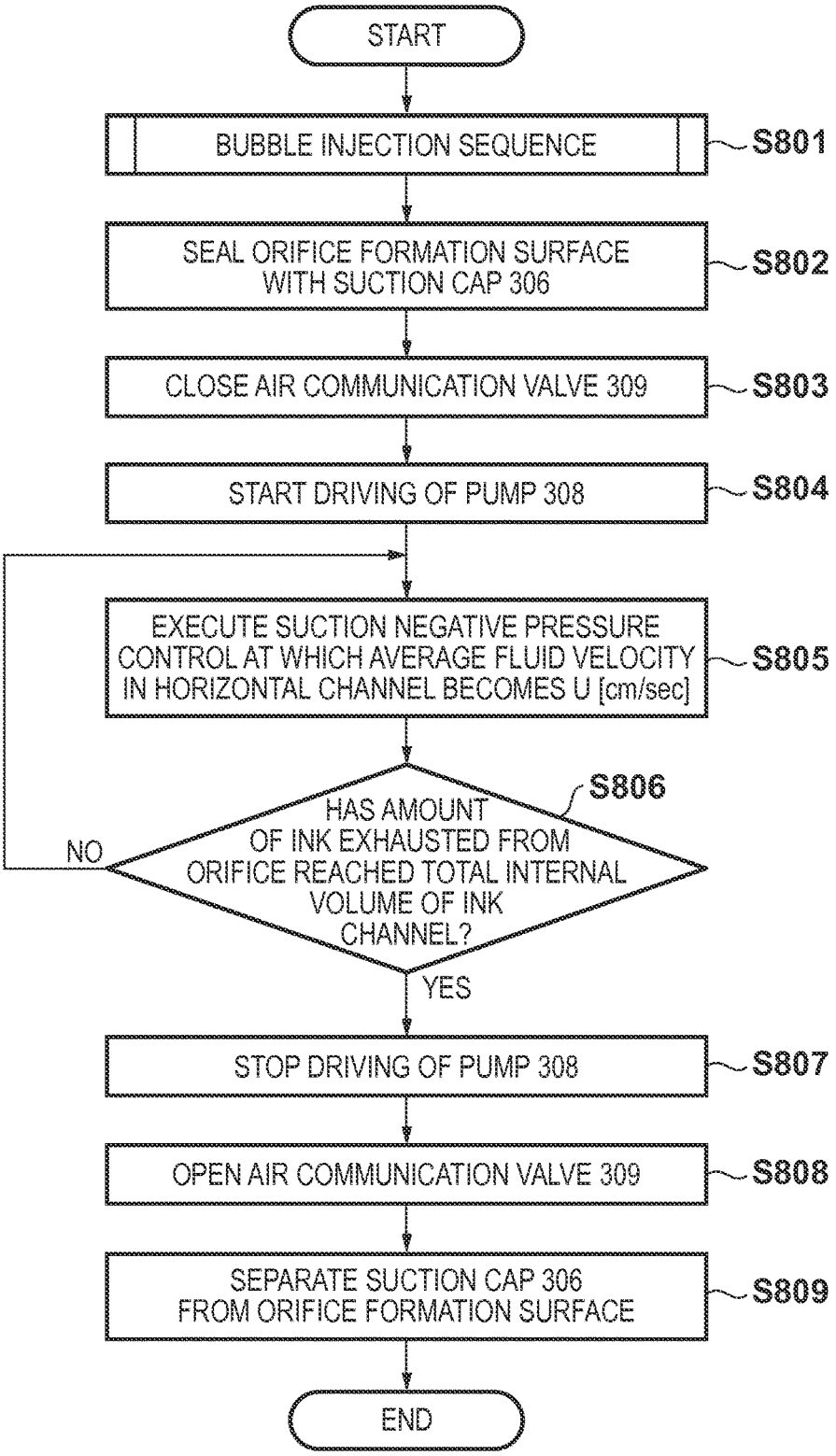
FIG. 9 is a flowchart showing a bubble exhaust operation from the ink channel according to the first embodiment of the present invention.

FIG. 9 is a flowchart showing a bubble exhaust operation from the ink channel according to the first embodiment.

When the carriage 106 exists at the home position, an operation of injecting a bubble into the ink channel, as shown in FIG. 4, is executed in step S801. A bubble is injected by about 30 [$mm^3$] which is about five times the fluid channel cross section by which the horizontal channel with an inner diameter of 3.0 [mm] can be sufficiently covered with a predetermined bubble amount V to be injected, a meniscus can be satisfactorily formed on the fluid channel cross section, and the area of the bubble in contact with the wall surface of the fluid channel is satisfactorily ensured. This is equivalent to step S405 of FIG. 4.

After executing the bubble injection sequence in step S801, a bubble generated in the ink channel and the bubble injected in step S801 are exhausted from the orifice by using the arrangement of sucking ink from the orifice, as shown in FIG. 3.

More specifically, in step S802, the suction cap 306 is moved in the +Z direction to seal the orifice formation surface of the printhead 102. In step S803, the air communication valve 309 is closed. In this state, driving of the pump 308 starts in step S804 to generate a negative pressure in the suction cap 306 and start ink suction from the orifice through the suction cap 306. In step S805, suction negative pressure control is executed so that an average fluid velocity U in the horizontal channel of the ink channel becomes about 0.8 [cm/sec].

In step S806, it is checked whether or not the amount of ink exhausted from the orifice has reached an ink amount corresponding to the total internal volume of the ink channel. If it is determined that the amount of ink exhausted from the orifice has not reached the ink amount corresponding to the total internal volume of the ink channel, the process returns to step S805 to continue suction negative pressure control. To the contrary, if it is determined that the amount of ink exhausted from the orifice has reached the ink amount corresponding to the total internal volume of the ink channel, the process advances to step S807. The driving of the pump 308 is stopped in step S807, the air communication valve 309 is opened in step S808, and finally the suction cap 306 is separated from the orifice formation surface in step S809.

Figure 10A:
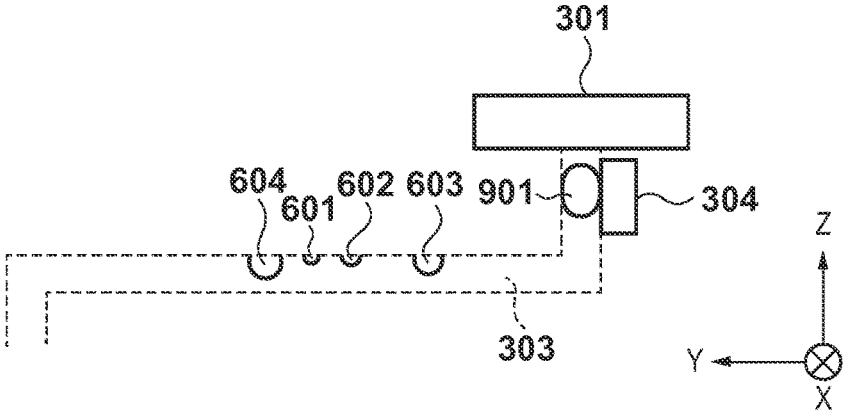
FIGS. 10A, 10B, and 10C are views each showing a state in the ink channel in a case where bubbles attached in the horizontal channel of the ink channel are exhausted according to the first embodiment of the present invention.
Figure 10B:
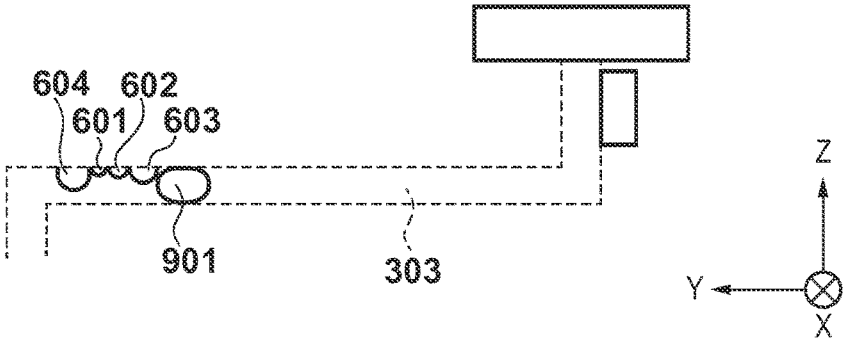
Figure 10C:
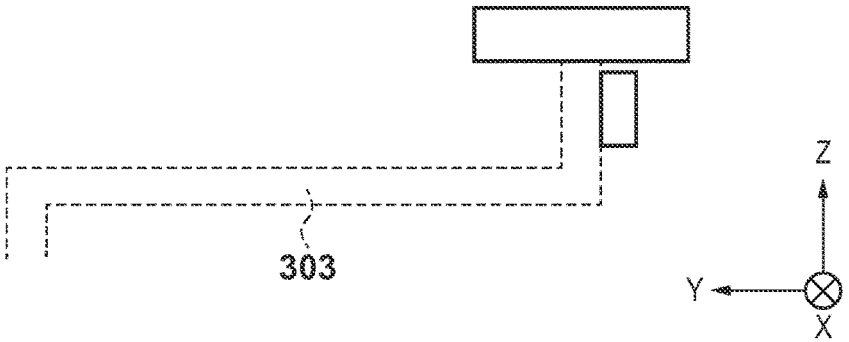

FIGS. 10A to 10C are views each showing a state in the ink channel when bubbles attached in the horizontal channel of the ink channel are exhausted according to the first embodiment. In FIGS. 10A to 10C, the sizes of the attached bubbles are about 0.5 [mm] to about 2.0 [mm] which are smaller than a bubble size of about 2.5 [mm] at which a print failure occurs in a case where an image is printed at a printing duty of 100% using all orifices.

FIG. 10A shows a state in which injection of a bubble 901 having a volume of about 30 [$mm^3$] has just ended according to the bubble injection sequence in step S801. FIG. 10B shows a state in which the injected bubble 901 pushes and moves the bubbles of about 0.5 to 2.0 [mm] attached at a suction negative pressure at which the average fluid velocity U in the horizontal channel of the ink channel 303 becomes about 0.8 [cm/sec] in step S805.

FIG. 10C shows a state in which driving of the pump 308 is stopped in step S807, and the injected bubble 901 and the bubbles 601 to 604 of about 0.5 to 2.0 [mm] in size attached in the horizontal channel of the ink channel are exhausted from the ink channel 303 through the orifice.

FIG. 11 is a table showing the average fluid velocity in the horizontal channel of the ink channel 303, and the ratio, to the internal volume of the ink channel, of the amount of ink consumed by suction until a bubble of a size movable at the average fluid velocity is exhausted from the orifice. In FIG. 11, a bubble of a movable size is a bubble of a size indicated by "X" in FIG. 7.

One of factors which make the ink amount larger than the internal volume of the ink channel is as follows. Till a fluid velocity at which bubbles attached to the wall surface do not move, only ink around the bubbles flows, and the amount of wasteful ink consumed by suction increases. As the average fluid velocity in the horizontal channel changes to be higher, the amount of wasteful ink consumed by suction greatly increases. The ink amount increases along with an increase in fluid velocity owing to the following two factors:

(1) an increase in the amount of ink which flows from the vicinity of bubbles and is consumed in a case where the pressure in the suction cap is gradually increased until the average fluid velocity in the horizontal channel reaches a target average fluid velocity from 0 [cm/sec]; and (2) an increase in the amount of ink consumed in a case where the pressure in the suction cap is gradually decreased until the average fluid velocity reaches 0 [cm/sec] from the target average fluid velocity conversely.

In the conventional arrangement, the average fluid velocity in the horizontal channel at which bubbles up to a bubble of 0.5 [mm] in size are exhausted is about 23.0 [cm/sec], so the amount of ink consumed by suction is about 12 times the internal volume of the ink channel. To the contrary, in the first embodiment, the average fluid velocity U in the horizontal channel of the ink channel capable of exhausting to bubbles of about 0.5 [mm] to about 2.0 [mm] in size can be decreased to about 0.8 [cm/sec].

At this time, bubbles move as shown in FIG. 10A even in a case where the pressure in the suction cap is gradually increased until the average fluid velocity in the horizontal channel reaches the target average fluid velocity of about 0.8 [cm/sec] from 0 [cm/sec]. More specifically, the meniscus of the cross section of the horizontal channel is satisfactorily formed by the bubble 901 which is injected according to the bubble injection sequence in step S801 and has a volume of about 30 [$mm^3$]. The bubbles move without generating the flow of ink from the vicinity of the bubbles. Thus, no wasteful ink consumption occurs. In contrast, a small amount of ink is consumed in a case where the pressure in the suction cap is gradually decreased until the average fluid velocity reaches 0 [cm/sec] in the stationary state from about 0.8 [cm/sec]. However, the consumed ink amount is about 1.5 times the internal volume of the ink channel, as shown in FIG. 11, and wasteful ink consumption can be greatly suppressed in comparison with the conventional method.

According to the above-described embodiment, a bubble is injected to the ink channel prior to ink suction, and then ink suction is performed by negative pressure control using the suction pump. Hence, ink consumption along with the suction can be greatly reduced. As a result, suppression of ink consumption along with bubble exhaust can be implemented while suppressing occurrence of a print failure by ink suction.

Second Embodiment

The second embodiment will explain a case in which the number of orifices is increased to expand the print scanning width so that printing can be performed at a higher speed than in the first embodiment.

The second embodiment will be explained on the premise of the following conditions.

More specifically, one printhead having the arrangement shown in FIG. 2 discharges black ink. The printhead is constituted to have L=1024 orifices, which is double the number of orifices in the first embodiment, and implement a print pixel density of 600 dpi at an orifice interval of 1/600 inches. The printhead is also constituted so that each orifice of the printhead can discharge an ink droplet of about 30 pl. The discharge frequency for stably discharging this ink droplet is 15 kHz. The speed of the carriage 106 supporting the printhead 102 in the main scanning direction is about 25 inches/sec at a printing resolution of 600 dpi in the main scanning direction. A maximum fluid flow at the time of printing by ink droplets from all orifices at a resolution of 600 dpi is 30 pl×1024×15000=about 0.46 [ml/sec].

Even in this embodiment, the inner diameter of a horizontal channel in which the top surface of an ink channel 303 shown in FIG. 3 exists is 3.0 [mm]. The average fluid velocity in the tube at the maximum fluid flow becomes about 6.8 [cm/sec]. Since the printing width of the printhead is expanded and the number of orifices is doubled, the internal volume of an approximately triangular ink chamber formed behind the plurality of orifices is increased about twice in comparison with the first embodiment.

In the embodiment, the average fluid velocity in the tube at the maximum fluid flow is about 6.8 [cm/sec]. Referring again to FIG. 7, movement starts from a bubble of about 2.0 [mm] in size attached in the horizontal channel, causing occurrence of a print failure. For this reason, the sizes of bubbles which should be exhausted are about 0.5 [mm] to about 1.5 [mm] which are smaller than about 2.0 [mm]. In the embodiment, it is controlled to exhaust bubbles of 0.5 [mm] to about 1.5 [mm] excluding the bubble 604 of about 2.0 [mm] in size shown in FIG. 10.

Figure 12:
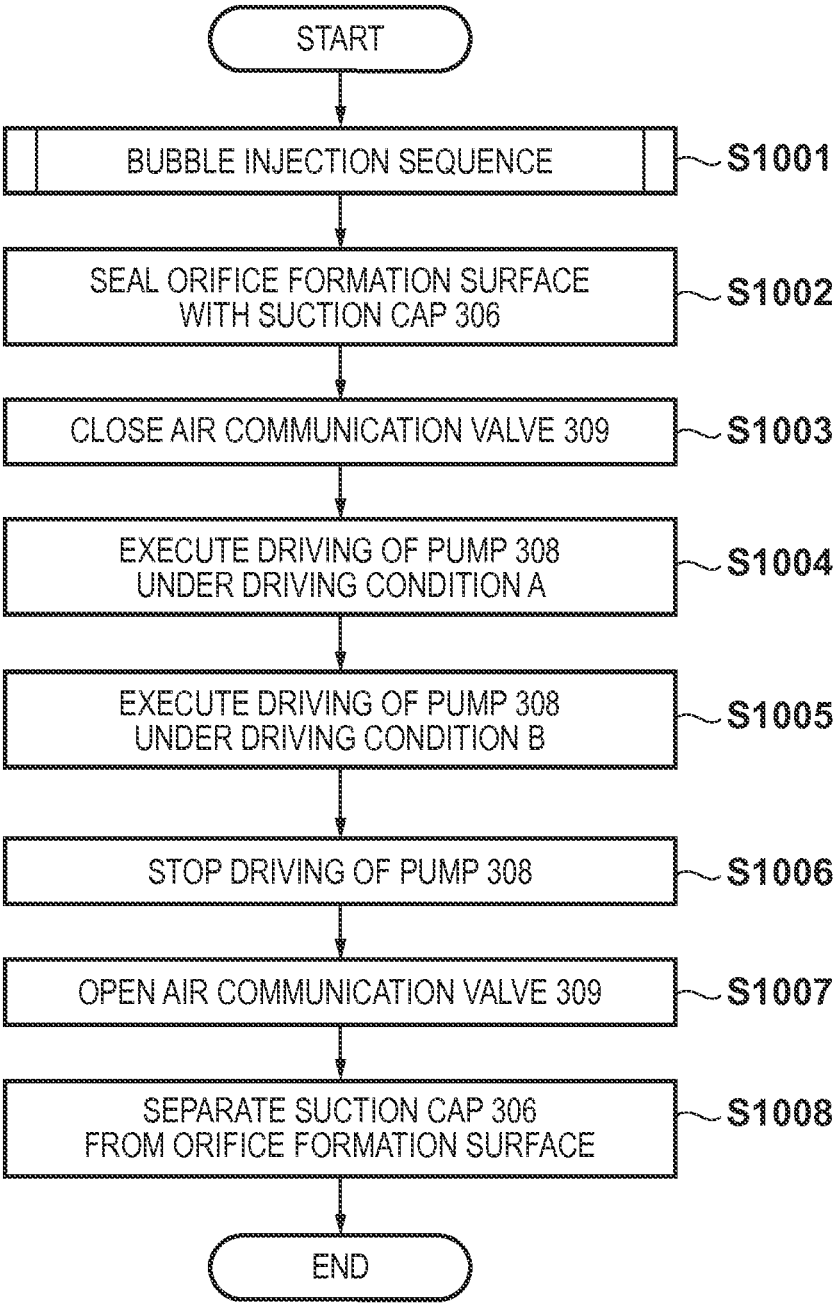
FIG. 12 is a flowchart showing a bubble exhaust operation from the ink channel according to the second embodiment of the present invention.

FIG. 12 is a flowchart showing a bubble exhaust operation from the ink channel according to the second embodiment. In FIG. 12, operations in steps S1001 to S1003 are the same as those in steps S801 to S803 shown in FIG. 9 that have been described in the first embodiment, and a description thereof will not be repeated.

After steps S1001 to S1003, the pump 308 is driven under the following driving condition A in step S1004.

Driving Condition A

Driving condition A is a driving condition necessary to move bubbles attached in the horizontal channel of the ink channel into the approximately triangular ink chamber formed behind the plurality of orifices.

Driving condition A is a condition that an average fluid velocity U in the horizontal channel of the ink channel becomes about 0.8 [cm/sec], and the amount of ink corresponding to the volume of a portion extending from a filter 301 to the inlet of the approximately triangular ink chamber of the printhead 102 is exhausted at this fluid velocity.

Then, the pump 308 is driven under the following driving condition B in step S1005.

Driving Condition B

Driving condition B is a driving condition necessary to exhaust, from the orifice, bubbles which have moved into the approximately triangular ink chamber of the printhead 102.

Driving condition B is a condition that the average fluid velocity U in the horizontal channel of the ink channel becomes about 0.8×2=about 1.6 [cm/sec], and ink is exhausted from the orifice at this fluid velocity by the volume of the approximately triangular ink chamber formed behind (above in the drawing (FIG. 3)) the orifices of the printhead 102. In the second embodiment, the fluid velocity necessary to exhaust, from the orifice, bubbles which have moved to the approximately triangular ink chamber needs to be doubled so that it becomes equal to the fluid velocity in the first embodiment, because the fluid channel cross section is double.

Thereafter, the driving of the pump 308 is stopped in step S1006, the air communication valve 309 is opened in step S1007, and the suction cap 306 is separated from the orifice formation surface in step step S1008.

Referring to FIGS. 7 and 11, in the conventional arrangement, the average fluid velocity in the horizontal channel at which bubbles up to a bubble of 0.5 [mm] in size are exhausted is about 23.0 [cm/sec], so the amount of ink consumed by suction becomes about 12 times the internal volume of the ink channel. To the contrary, in the second embodiment, the average fluid velocity U in the horizontal channel of the ink channel capable of exhausting bubbles of about 0.5 [mm] to about 1.5 [mm] in size serves as the driving condition of the pump which generates negative pressures at which a combination of two types: about 0.8 [cm/sec] and about 1.6 [cm/sec] is achieved. The ratio, to the internal volume of the ink channel, of the amount of ink consumed by suction is about 1.7 times, greatly suppressing wasteful ink consumption.

According to the above-described embodiment, a bubble is injected to the ink channel, then a negative pressure is generated in the ink chamber using the suction pump, and ink suction is executed by performing control of further generating a negative pressure higher than the generated negative pressure. Even for a printhead with a long printing width in which the number of orifices is large, suppression of ink consumption along with bubble exhaust can be implemented while suppressing occurrence of a print failure by ink suction.

Third Embodiment

An example of performing control to change, in accordance with the standing time, an operation of exhausting bubbles in the ink channel will be explained. A printhead in the third embodiment has the same arrangement as that in the first embodiment.

Referring to FIG. 8, the time taken to generate a bubble and grow to a size of about 2.5 [mm] at which the bubble moves when printing an image at a printing duty of 100% using all orifices is about 240 hours. The time taken for a bubble to grow up to a size at which it covers the inside of a horizontal channel having an internal diameter of 3.0 [mm] is about 740 hours.

Figure 13:
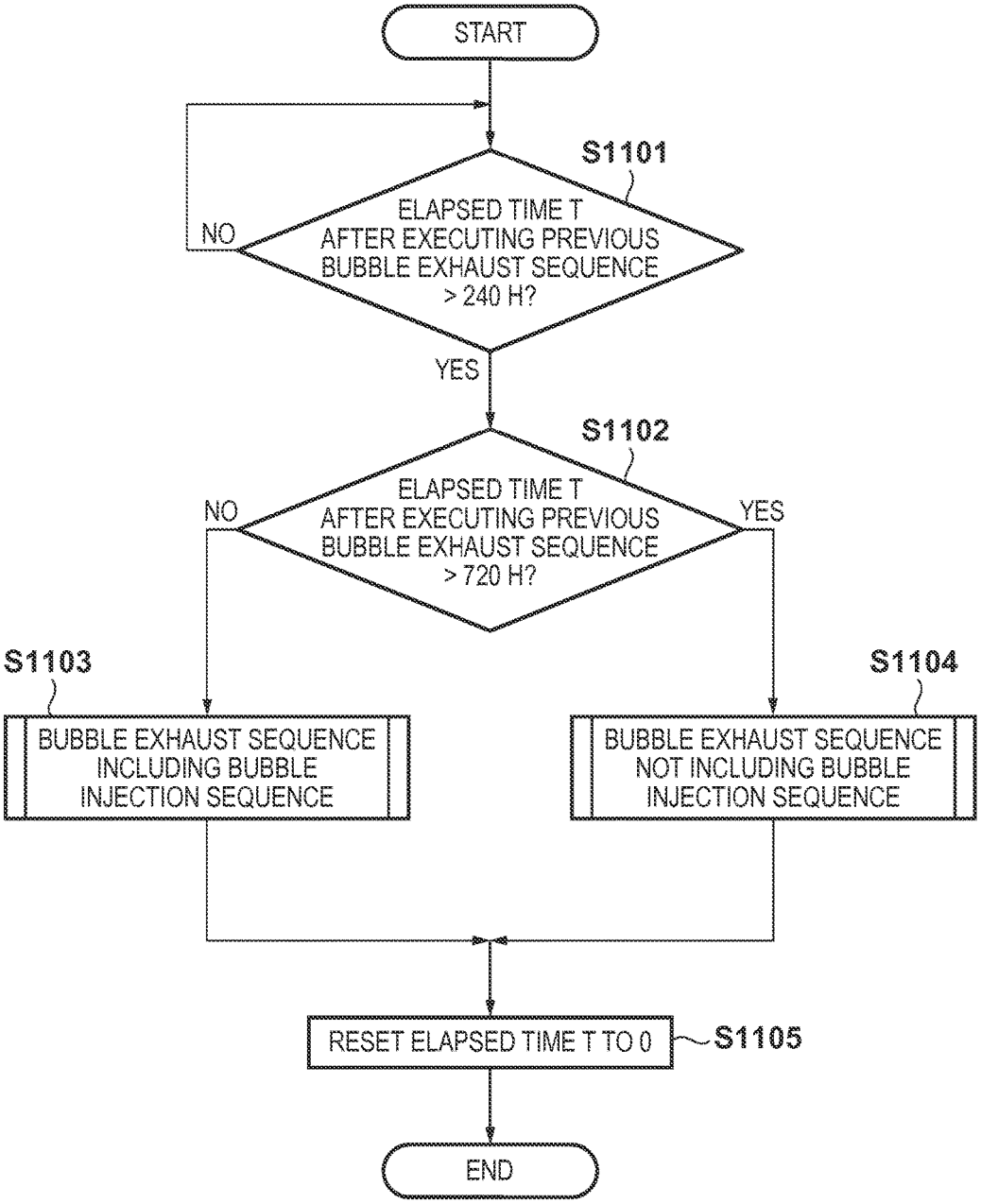
FIG. 13 is a flowchart showing a bubble exhaust operation from the ink channel according to the third embodiment of the present invention.

FIG. 13 is a flowchart showing a bubble exhaust operation from the ink channel according to the third embodiment.

In step S1101, the elapsed time T after executing the previous bubble exhaust sequence is monitored to check whether or not the elapsed time has exceeded 240 hours (h). If T≤240 h, the process waits until the elapsed time T has exceeded 240 h. If T>240 h, the process advances to step S1102 to check whether or not the elapsed time T after executing the previous bubble exhaust sequence has exceeded 740 hours (h).

If the elapsed time T satisfies 240<T≤720 h, the process advances to step S1103 to execute a bubble exhaust sequence including the bubble injection sequence described in the first embodiment with reference to FIG. 9. To the contrary, if T>720 h, the process advances to step S1104 to execute a bubble exhaust sequence not including the bubble injection sequence. The bubble exhaust sequence not including the bubble injection sequence is an operation in which step S801 is excluded from the flowchart shown in FIG. 8.

After executing the bubble exhaust sequence in step S1103 or S1104, the elapsed time T is reset to "0" in step S1105.

As described above, the third embodiment adopts the "bubble exhaust sequence not including the bubble injection sequence" in addition to the "bubble exhaust sequence including the bubble injection sequence". In a case where it is predicted that a bubble of a size enough to cover the horizontal channel of the ink channel already exists without performing bubble injection, the bubble injection sequence is not executed, and the time taken for bubble exhaust can be greatly shortened.

According to the above-described embodiment, bubble injection is suppressed in accordance with the elapsed time after the previous bubble exhaust operation. The time taken for bubble exhaust can be further shortened in addition to suppression of occurrence of a print failure, and suppression of wasteful ink consumption along with bubble exhaust.

Note that the above-described embodiments have explained an arrangement in which bubbles are exhausted at as low as the average fluid velocity U of about 0.8 [cm/sec] in the horizontal channel of the ink channel after the bubble injection sequence. However, the present invention is not limited to this average fluid velocity. Compared to the conventional arrangement, the above-described arrangement can prevent an increase in the amount of ink which flows from the vicinity of bubbles and is consumed when the pressure in the suction cap is gradually increased until the average fluid velocity in the horizontal channel reaches a target average fluid velocity from 0 [cm/sec]. As an arrangement which slightly increases the average fluid velocity in the horizontal channel, suppression of wasteful ink consumption may be implemented while shortening the time taken for bubble exhaust.

The above-described embodiments have exemplified an arrangement in which a bubble is injected to the ink channel by using the hollow needle. However, the present invention is not limited to this. For example, the hollow needle inserted through the rubber sealing portion remains open to the air. In this state, the orifice formation surface of the printhead is sealed with the suction cap, and the pump sucks the orifice formation surface to apply a negative pressure in the ink channel and inject a bubble. A pump (third pump) may pressurize air to inject a bubble, as an arrangement in which an ink channel and openable/closable valve are arranged at the position of the rubber sealing portion, instead of the arrangement in which the hollow needle is inserted. In this manner, the arrangement in which the air communication port is formed and open to the air, or the arrangement in which a bubble is injected by pressurization is also possible without arranging the pump 307 shown in FIG. 3.

Further, the above-described embodiments have explained an arrangement in which the ink tank storing ink is arranged on the printhead. However, the present invention is not limited to this arrangement. For example, an ink tank may be provided at a position different from the carriage, and ink may be supplied to the printhead through a tube or the like. In this case, the same effects as those in the above-described embodiments can be obtained by arranging a bubble injection arrangement at a position near the ink tank.

Also, the above-described embodiments have explained a case in which one printhead for discharging black ink is arranged. However, the present invention is not limited to this arrangement. For example, it is also possible to use a printhead including orifice arrays for discharging inks of four colors including cyan ink, magenta ink, and yellow ink, provide bubble injection arrangements for the ink channels of the respective color inks, and provide a cap and pump capable of sucking the inks of the four colors at once.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-242361, filed Nov. 22, 2013, which is hereby incorporated by reference herein in its entirety.

What is claimed is:

1. A printing apparatus comprising:

a printhead in which a plurality of nozzles are provided for discharging ink;

an ink tank for storing ink to be supplied to the printhead;

an ink channel for supplying ink from the ink tank to the printhead;

a bubble injection unit configured to perform a bubble injection operation to inject a bubble to the ink channel;

a cap capable of covering the nozzles;

a first pump configured to perform a first suction operation and a second suction operation that is stronger than the first suction operation, so as to suck ink from the nozzles through the cap; and a control unit configured to control the bubble injection unit and the first pump, wherein the control unit causes the bubble injection unit to perform the bubble injection operation, and then causes the first pump to perform the first suction operation and the second suction operation following the first suction operation while maintaining a capping state where the nozzles are covered by the cap.

2. The apparatus according to claim 1, wherein the ink channel includes:

a horizontal portion arranged in a horizontal direction; and an upstream portion arranged at a position higher than the horizontal portion on an upstream side in an ink supply direction with respect to the horizontal portion, wherein the bubble injection unit is arranged at the upstream portion.

3. The apparatus according to claim 2, wherein a filter is arranged in the ink channel on an upstream side with respect to the bubble injection unit.

4. The apparatus according to claim 3, wherein the control unit controls the bubble injection unit such that a size of the bubble injected in the ink channel is not smaller than a size of a cross section of the horizontal portion.

5. The apparatus according to claim 1, wherein the bubble injection unit includes:

a hollow needle configured to be able to inserted into the ink channel; and a second pump configured to supply a gas to the ink channel through the hollow needle.

6. The apparatus according to claim 1, wherein the bubble injection unit includes:

a third pump capable of pressurizing a gas and injecting the pressurized gas to the ink channel; and a valve configured to switch between a state where the third pump communicates with the ink channel and a state where the third pump does not communicate with the ink channel.

7. The apparatus according to claim 1, wherein the bubble injection unit includes an air communication port capable of introducing air into the ink channel.

8. The apparatus according to claim 1, wherein the ink channel has a circular sectional shape.

9. A method for exhausting a bubble in a printing apparatus including: a printhead in which a plurality of nozzles are provided for discharging ink; an ink tank for storing ink to be supplied to the printhead; an ink channel for supplying ink from the ink tank to the printhead; a cap capable of covering the nozzles; and a pump configured to suck ink from the nozzles through the cap, comprising:

injecting a bubble to the ink channel;

performing a first suction operation by the pump under a capping state where the nozzles are covered by the cap after injecting the bubble; and performing a second suction operation that is stronger than the first suction operation by the pump following the first suction operation while maintaining the capping state.

* * * * *